US007748361B2

(12) United States Patent
Linz et al.

(10) Patent No.: US 7,748,361 B2
(45) Date of Patent: Jul. 6, 2010

(54) PISTON FOR A COMBUSTION ENGINE, AND COMBUSTION ENGINE

(75) Inventors: Roland Linz, Nurnberg (DE); Kurt Voit, Allersberg (DE)

(73) Assignee: Federal-Mogul Nurnberg GmbH, Nurnberg (DE)

( * ) Notice: Subject to any disclaimer, the term of this patent is extended or adjusted under 35 U.S.C. 154(b) by 16 days.

(21) Appl. No.: 11/575,010

(22) PCT Filed: Sep. 1, 2005

(86) PCT No.: PCT/EP2005/009420

§ 371 (c)(1),
(2), (4) Date: Dec. 31, 2007

(87) PCT Pub. No.: WO2006/027157

PCT Pub. Date: Mar. 16, 2006

(65) Prior Publication Data

US 2008/0289490 A1 Nov. 27, 2008

(30) Foreign Application Priority Data

Sep. 9, 2004 (DE) ..... 10 2004 043 720

(51) Int. Cl.
*F01P 1/04* (2006.01)

(52) U.S. Cl. ..... 123/193.6; 123/41.35

(58) Field of Classification Search ..... 123/41.35, 123/41.16, 193.6; 92/186
See application file for complete search history.

(56) References Cited

U.S. PATENT DOCUMENTS

| | | | | | |
|---|---|---|---|---|---|
| 2,865,348 | A | * | 12/1958 | Kramer et al. | 123/41.35 |
| 4,011,797 | A | * | 3/1977 | Cornet | 92/186 |
| 4,206,726 | A | * | 6/1980 | Johnson et al. | 123/41.35 |
| 4,331,107 | A | * | 5/1982 | Bruni | 123/41.35 |
| 4,428,330 | A | * | 1/1984 | Shimizu | 123/41.35 |
| 4,530,312 | A | | 7/1985 | Kanda et al. | |
| 5,595,145 | A | | 1/1997 | Ozawa et al. | |
| 5,845,611 | A | | 12/1998 | Schmidt et al. | |
| 5,890,416 | A | | 4/1999 | Thieme et al. | |
| 6,032,619 | A | * | 3/2000 | Zhu et al. | 123/41.35 |
| 6,499,386 | B2 | * | 12/2002 | Martin et al. | 92/186 |
| 6,532,913 | B1 | * | 3/2003 | Opris | 123/41.35 |
| 2002/0162448 | A1 | | 11/2002 | Martin et al. | |

FOREIGN PATENT DOCUMENTS

| | | | |
|---|---|---|---|
| DE | 10218653 | A1 | 11/2003 |
| EP | 1063 409 | B1 | 12/2000 |
| EP | 1231374 | A2 | 8/2002 |
| JP | 2001182613 | A | 7/2001 |
| WO | WO 01/09503 | A1 | 2/2001 |

* cited by examiner

*Primary Examiner*—M. McMahon
(74) *Attorney, Agent, or Firm*—Robert L. Stearns; Dickinson Wright PLLC

(57) ABSTRACT

Disclosed is a piston for a combustion engine, comprising a cooling duct with a single inlet port and at least two outlet ports, at least two of which are separated from each other regarding the discharged coolant. Also disclosed is a combustion engine comprising at least one such piston.

15 Claims, 2 Drawing Sheets

PISTON FOR A COMBUSTION ENGINE, AND COMBUSTION ENGINE

FIELD OF THE INVENTION

The present invention relates to a piston for a combustion engine, and a combustion engine with an innovative piston.

The pistons of combustion engines are exposed to high thermal loads during operation. The pistons may be cooled by appropriate measures in order to prevent excessive temperatures. This takes place essentially in that the relevant piston is lubricated with a coolant, usually oil, from the side of the crankcase. Such a coolant is in contact with the piston for at least a certain length of time with the result that it can absorb heat from said piston. It is possible to maintain the temperature of the piston within a safe range by ensuring that the coolant thus heated is discharged and that provision is also made for comparatively cool coolant to flow in to replace it.

PRIOR ART

DE 102 18 653 A1 discloses a piston in which a ring carrier is provided with a cooling duct plate that may comprise a plurality of flat spots. The flat spots may be drilled to create inlets and outlets. As the coolant duct created is circumferential, in the case where two outlets are provided, these are connected together.

This applies in the same manner for the piston according to EP 1 063 409 A2 in which two symmetrical inlet ports are provided, of which only one is used at any time depending on the orientation when the piston is installed. The remaining inlet port may be used as an outlet port but is, nevertheless, also connected to the outlet port which is provided anyway.

Finally, a piston emerges from EP 1 231 374 A2 which has various overlapping areas in regions next to the piston pin hub. These areas are lubricated from the side of the piston housing with cooling oil which can flow in sections through what are referred to as passage ducts.

PRESENTATION OF THE INVENTION

The object of the invention is to create a piston for a combustion engine, in addition to a combustion engine which is improved in respect of the possibility for ensuring reliable cooling.

This object is achieved by the piston described in claim 1.

Accordingly, the piston comprises a cooling duct with one single inlet port and at least two outlet ports. At least two of the outlet ports are separated from each other in respect of the coolant discharged. This is understood to mean that in the vicinity of the outlet ports there is no flow connection between them. Rather, the coolant, which flows by way of a corresponding duct section from the inlet port to an outlet port that is fluidically separated from other outlet ports, can escape from this outlet port unimpeded. The case where coolant from different duct sections is discharged through one and the same outlet port does not arise. In fact, each duct section or "partial duct" has at least one "dedicated" outlet port i.e. assigned to this duct section only. In particular, a connection in the form of a preferably small passage may be provided in the region of the outlet ducts. It is not, however, envisaged that coolant from the one coolant duct section will flow through this passage into the other coolant duct section or to its outlet port. In fact, the coolant is directed, by means of a suitable embodiment of the walls in the region of the relevant outlet port, out of the respective coolant duct section to the relevant outlet port assigned to this coolant duct section. In an advantageous manner this prevents interference and disruption of the coolant discharge in the other coolant duct section respectively. The inlet port may also be described as an inflow, an inlet, an inlet port, admittance port, intake or entry port. Likewise, the outlet port might also be referred to merely as an outflow or an exit port.

The measure according to the invention ensures the following advantages. The cooling effect is dependent amongst other things on the coolant's dwell time in the cooling duct. In particular, it is possible to match the desired cooling effect to the fact that the coolant leaves the cooling duct after a specific dwell time. According to the invention it is possible to guarantee this particularly well in that the coolant jet can escape unimpeded at the outlet port. Unlike in a situation where two coolant flows unite at an outlet port and interfere with each other, it is possible with the piston according to the invention for the coolant flow to escape without disturbance. This improves the cooling effect.

In particular, it is also possible by means of the piston according to the invention to improve the cooling of a piston in which the cooling duct is made up of two sections of unequal length. Due to the piston's up and down movement, a pulsed flow arises, namely in the cooling duct. Thus the pressure wave of the shorter cooling duct section can reach the outlet port before the pressure wave of the longer section and impede the coolant flow's escape from the longer section. There thus arises a longer dwell time of the coolant in this longer section and a deterioration of the cooling. In such a situation, the measure according to the invention creates an effective remedy and in particular enables efficient cooling even in a case where a cooling duct has two sections of unequal length. In summary, there is prevention of back pressure or turbulences at the exit of the coolant flows. It has also transpired during investigations that, due to the measure according to the invention, it is possible to achieve an almost laminar flow of the coolant, particularly of the cooling oil, which is extremely favourable for heat transfer.

In conjunction with this, there is also the advantage that, due to the possibility of providing duct sections of unequal length and of nevertheless ensuring efficient cooling, the inlet port may be disposed off-centre. In this case, however, it is possible to retain a central disposal of the outlet ports to the effect that they are located above the piston pin, in particular between the pin hubs and the small connecting rod boss. Such a disposal is advantageous for the best possible lubrication of the jointed connection between the piston pin and the pin hub or the connecting rod boss. The two outlet ports may be disposed in particular and in an advantageous manner to the left and right of the connecting rod boss in order to ensure beneficial lubrication at this point. This advantage may be realised in particular with a coolant jet which runs substantially parallel to the piston axis. By comparison, it is known in prior art to use an inclined coolant jet which, depending on the piston's position within the scope of the up/down direction, enters one of two inlet or entry ports. In such a case also, the coolant jet is divided into individual duct sections. However, to a substantially greater degree, up to 20%, there is an unutilised "squirting" of the oil at the dividing rib between the two inlet ports. By comparison, the coolant jet possible according to the invention, which is provided substantially parallel to the piston axis, can be utilised fully since, irrespective of the piston's up/down movement, it can always hit the same point on a dividing rib which is optimised in respect of flow geometry. Thus the coolant jet may be divided largely without losses into two or more duct sections which may be of varying length.

It should additionally be mentioned that a combination of features achieving the advantages according to the invention, which is new by comparison with prior art, may be seen in that a largely circumferential cooling duct has at least one inlet port and at least two outlet ports which are separated from each other in respect of the coolant discharged. By means of a piston provided with these features, it is likewise possible to achieve improvements by comparison with the prior art. This also applies to a piston wherein the cooling duct comprises at least one inlet port, to which are connected at least two duct sections, each with a single outlet port assigned only to the respective duct section. These last described embodiments are to be considered as the subject matter of the application and may be combined in particular with all the features previously and subsequently referred to.

In addition, the cooling duct of the piston according to the invention is designed as largely circumferential. Although it is conceivable that only individual regions of the piston will be cooled by the cooling duct embodied according to the invention, it is preferable to provide two largely semi-circular cooling duct sections. This means that the two outlet ports are disposed adjacent to one another but are nevertheless separated from one another. Since there is no continuation of the circumferential design at this point in specific embodiments, a cooling duct embodied in this manner is described as largely circumferential.

For flow conditions which are particularly efficient in respect of heat transfer, it has proven advantageous to provide at least one flow dividing element in the region of the inlet port. This may, for example, be a rib or a bead onto which the coolant flow flows by way of a nozzle for example. The flow dividing element divides the coolant flow into the respective duct sections. Since, as referred to, at least two duct sections each have their "own" outlet port, it is possible to guarantee that the coolant can flow without obstruction and that the flow of coolant taking its place is not impeded. The flow dividing element is preferably optimized in respect of flow geometry such that the coolant flow can be divided into the at least two directions largely without turbulence losses. Preferably, the flow dividing element is designed at the inlet such that at best gentle changes of direction are brought about and abrupt changes of direction are prevented. As a result it is largely possible to rule out flow losses and turbulences.

In experiments it has transpired that due to the measures described above it is already possible to ensure a particularly low-loss coolant flow which is efficient in respect of heat transfer. A further improvement may, however, be achieved by means of the preferred measure according to which an at least largely constant cross-section is provided in the region of at least one of the cooling duct sections between the inlet port and the relevant outlet port. The flow conditions can be further improved as a result of this.

As mentioned above, the measure according to the invention enables the cooling duct to have sections of unequal length. It was also explained that this is advantageous in respect of utilizing the coolant jet fed in. This may be achieved in particular by means of the preferred measure in that the inlet port is provided asymmetrically in relation to the outlet ports. This is preferred so as to enable a coolant jet which is largely parallel to the piston axis and which may be fed in at the inlet with particularly low losses.

In addition, it is preferred for the cooling duct of the piston according to the invention that said duct is designed overall as largely circumferential. Although it is conceivable that only individual regions of the piston will be cooled by the cooling duct embodied according to the invention, it is preferable to provide two largely semi-circular cooling duct sections. This means that the two outlet ports are disposed adjacent to each another but are nevertheless separated from one another. Since there is no continuation of the circumferential design at this point in specific embodiments, a cooling duct embodied in this manner is described as largely circumferential.

By means of particular measures it is possible to improve the piston according to the invention not only by improving the cooling but also in respect of lubricating the joint between the piston pin and the piston pin bosses and the connecting rod boss respectively. This may be achieved in that at least one outlet port is aimed towards a piston pin boss. In other words, a preferably gentle deflection takes place at the outlet port in a direction away from the piston crown or, with a conventional piston alignment, "downwards". In this preferred embodiment, therefore, the escaping coolant jet is aimed towards the piston pin and can ensure beneficial lubrication here. In an advantageous manner, the desired deflection at the outlet port may also take place at this point in such a gentle way and without abrupt changes of direction that the coolant flow's escape is largely unobstructed and turbulence-free.

It is further preferable to provide at least one outlet port in a region between the piston pin bosses albeit usually offset to the edge. With regard to particularly efficient lubrication of the piston pin, this enables favourable direction of the coolant jet onto the areas to be lubricated.

Preferably, the piston according to the invention is further combined with a piston pin and a connecting rod. With such a combination it is possible to detect particularly favourable lubrication conditions at the piston pin if at least one outlet port is situated in a region between a piston pin boss and the connecting rod boss, although typically on an edge of the piston. As a result of this, both the joint between the piston pin and the piston pin boss and also the connection to the connecting rod boss can be lubricated efficiently by the coolant flow discharged.

Basically, the piston according to the invention is presented as independently marketable. However, it displays its advantages particularly when in the state of being installed in a combustion engine. In this respect, a combustion engine with at least one such piston is also considered to be the subject matter of the application.

For the combustion engine embodied in this manner according to the invention, it is preferable for the efficient utilisation of a coolant jet for said combustion engine to have a means for generating a coolant jet which runs largely parallel to the piston axis. By means of such a coolant jet, which may be used in an advantageous manner in a piston according to the invention provided asymmetrically with an inlet port, significantly lower losses arise at the inlet port than is the case for disposals with an inclined coolant jet known in prior art. Although, as mentioned above, it is advantageous if the coolant jet runs largely parallel to the piston axis, this is not absolutely necessary. In fact, the coolant jet may also run obliquely or slope towards the piston axis in any manner.

BRIEF DESCRIPTION OF THE DRAWINGS

An embodiment of the invention illustrated by way of example in the drawings will be described in greater detail in the following. The drawings show.

DETAILED DESCRIPTION OF A PREFERRED EMBODIMENT OF THE INVENTION

Figure 1:
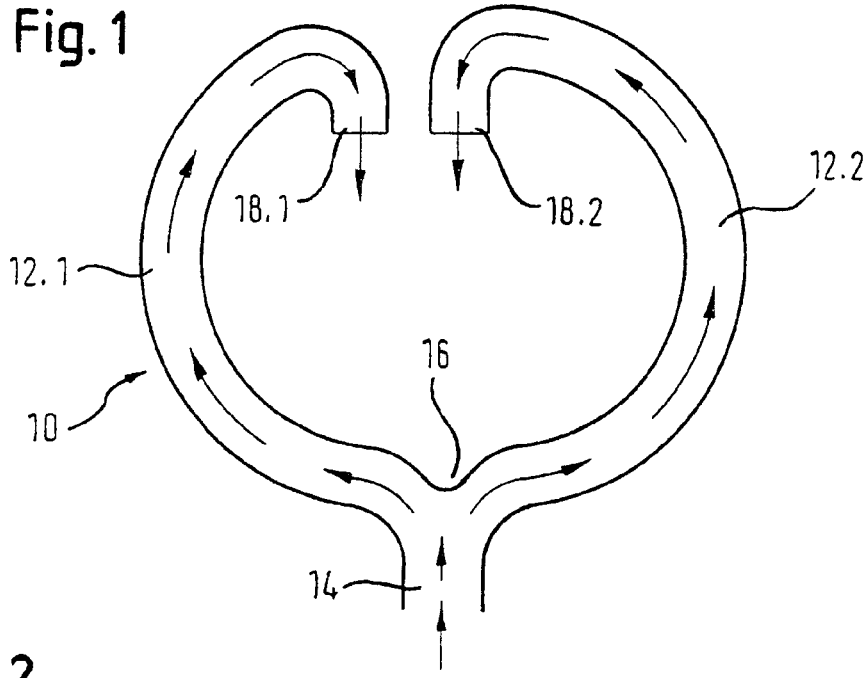
FIG. 1 schematically the cooling duct of the piston according to the invention and the flow generated therein.

FIG. 1 shows schematically a cooling duct 10 of the piston according to the invention. Said piston has substantially two semi-circular cooling duct sections 12.1 and 12.2. The coolant flows into cooling duct 10 through a single inlet port 14 at which the coolant flow is divided by a flow dividing element 16, preferably in the shape of a rib or a bead, into the two partial flows in cooling duct sections 12.1 and 12.2. Flow dividing element 16 is fluidically optimised such that no abrupt but rather gentle changes of direction take place and the flow losses and turbulences remain low. The coolant flow leaves relevant cooling duct section 12.1 and 12.2 respectively through a dedicated outlet port 18.1 and 18.2 assigned in each case only to the respective cooling duct section. In the region of relevant cooling duct section 12 and outlet port 18, walls necessary for the deflection are likewise embodied harmoniously and optimised in respect of flow geometry so that no abrupt changes of direction and turbulences arise. Rather the coolant flow can escape largely unobstructed from relevant outlet port 18. In particular, the two coolant flows do not interfere with each other due to the fluidic separation at the outlet. In respect of FIG. 1, it is understood that the representation is highly schematical and normally neither the inflow nor the outflow takes place "laterally" into or out of cooling duct 10. Rather cooling duct 10 is constructed in a plane largely perpendicular to the piston axis. Inflow and/or outflow takes place largely parallel to the piston axis, that is, from the underside of the piston. This cannot be seen in the schematic representation of FIG. 1 but does, however, emerge from FIG. 2.

Figure 2:
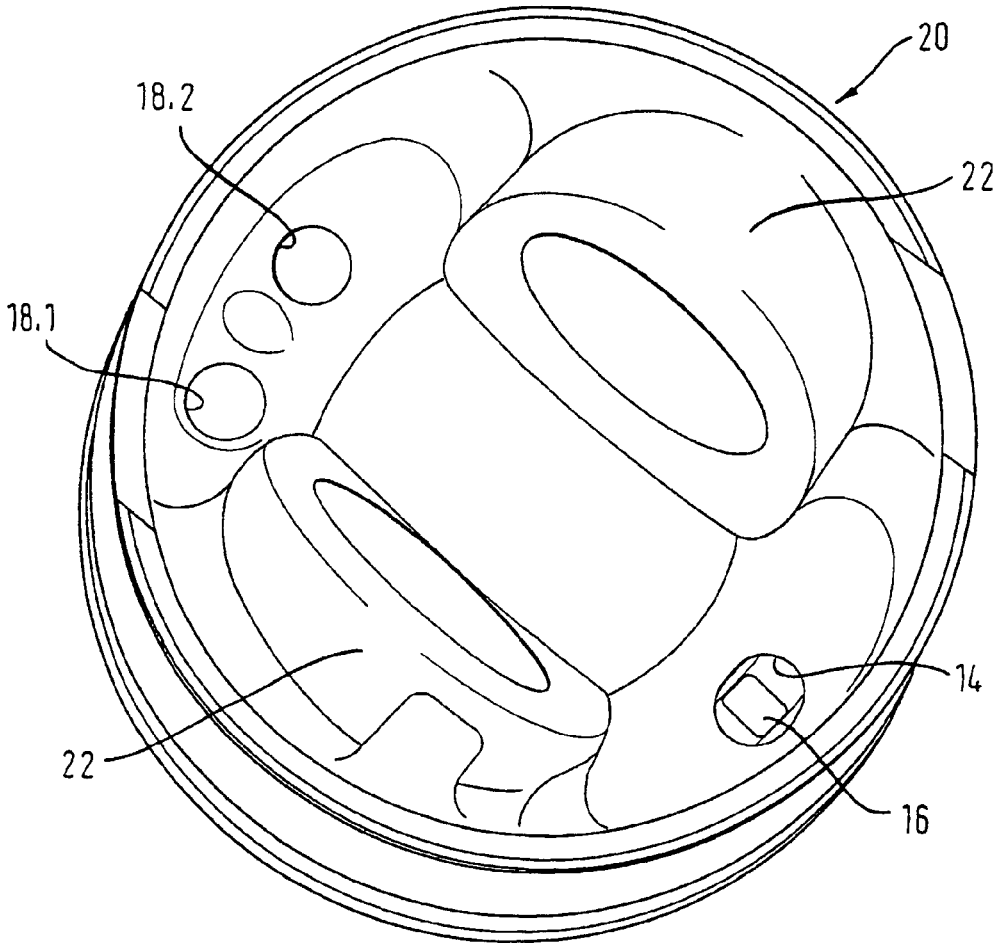
FIG. 2 the underside of a piston according to the invention.

FIG. 2 shows a piston 20 according to the invention from the underside so that inlet port 14 and both outlet ports 18 are discernible. Approximately in the area of the middle of inlet port 14 is located flow dividing element 16 which is formed in the shape of a rib or bead. By flowing the coolant jet against flow dividing element 16, said jet is directed partly into the one cooling duct section 12.1 and the other cooling duct section 12.2 (cf. FIG. 1). According to FIG. 2, these sections 12 each extend approximately in the shape of a semi-circle starting from inlet port 14 in the region above piston pin 22 discernible in FIG. 2. On the opposing side, cooling duct sections 12 each have their own outlet port 18. A deflection "downwards" takes place in the region of relevant outlet port 18, that is, towards the viewer according to the representation in FIG. 2. In the piston's installed state, a piston pin is located in piston pin bosses 22 and the connecting rod boss is located between the piston pin bosses. The coolant deflected towards the piston pin boss may in a beneficial manner be used for lubricating the joints between the piston pin and the piston pin bosses and the connecting rod boss respectively. In conjunction with this, it also transpires from FIG. 2 that the "region between the piston pin bosses" is understood to be the approximately strip-shaped area between inlet port 14 and outlet port 18.2. In this region, particularly on one edge of the piston, is located, in the embodiment illustrated, at least outlet port 18.2 with the result that the coolant jet discharged from here at least partially reaches the piston pin, not shown, inserted into piston pin bosses 22.

It may further be seen in FIG. 2 that inlet port 14 is provided asymmetrically in relation to outlet ports 18, and that consequently the cooling duct section to outlet port 18.1, on the left in FIG. 1, is shorter than the other cooling duct section. Due to the fluidically separated outlet ports, however, it is possible to prevent the flow discharged from the longer cooling duct section from being unfavourably obstructed by a pressure wave which would be first to reach a common outlet port from the side of the shorter cooling duct section. Inlet port 14 may also, however, be disposed centrally between piston pin bosses 22. Equally it may, otherwise than shown in FIG. 2, be provided in a position further offset towards piston pin bosses 22.

Figure 3:
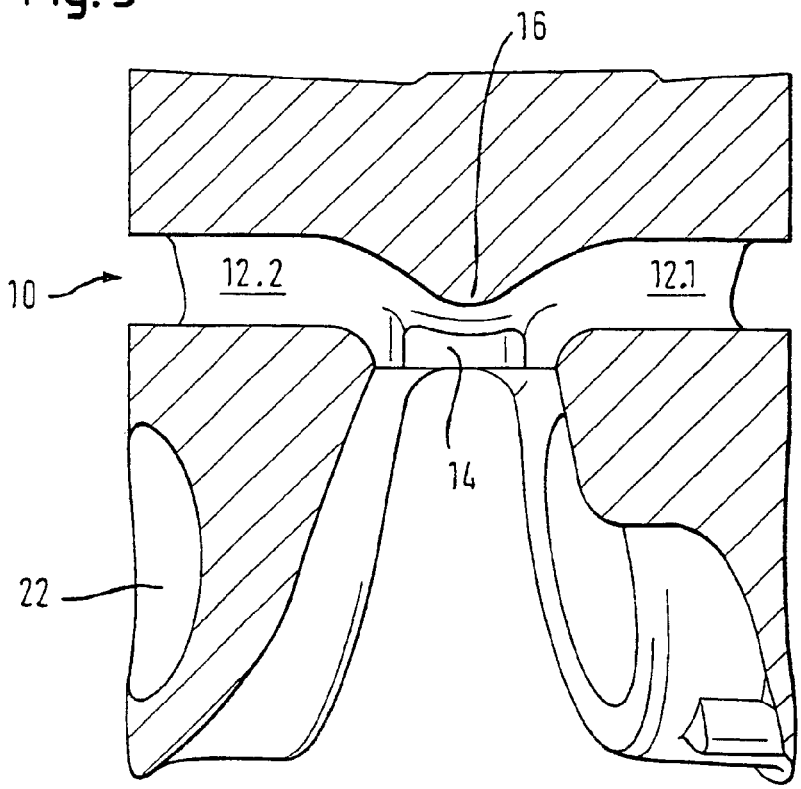
FIG. 3 a sectional view of the piston according to the invention in the region of the inlet port.

FIG. 3 shows both cooling duct sections 12.1 and 12.2 in a radial section of piston 10. Flow dividing element 16 can be seen in the region of common inlet port 14. It also emerges from FIG. 3 that the cross-section of cooling duct sections 12.1, 12.2 is at least largely constant over the extension of each section with the result that the favourable and largely unimpeded flow of coolant is assisted. The cross-section remains constant, particularly proceeding from the point at which flow dividing element 16 is formed at an angle to cooling duct section 12.1 and 12.2 respectively. In the embodiment shown in FIG. 3 it can also be seen that inlet port 14 is situated off-centre. This results because in the illustration shown in FIG. 3, the piston is twisted slightly to the right so that it is possible to see the inner surface of left-hand piston pin boss 22.

Figure 4:
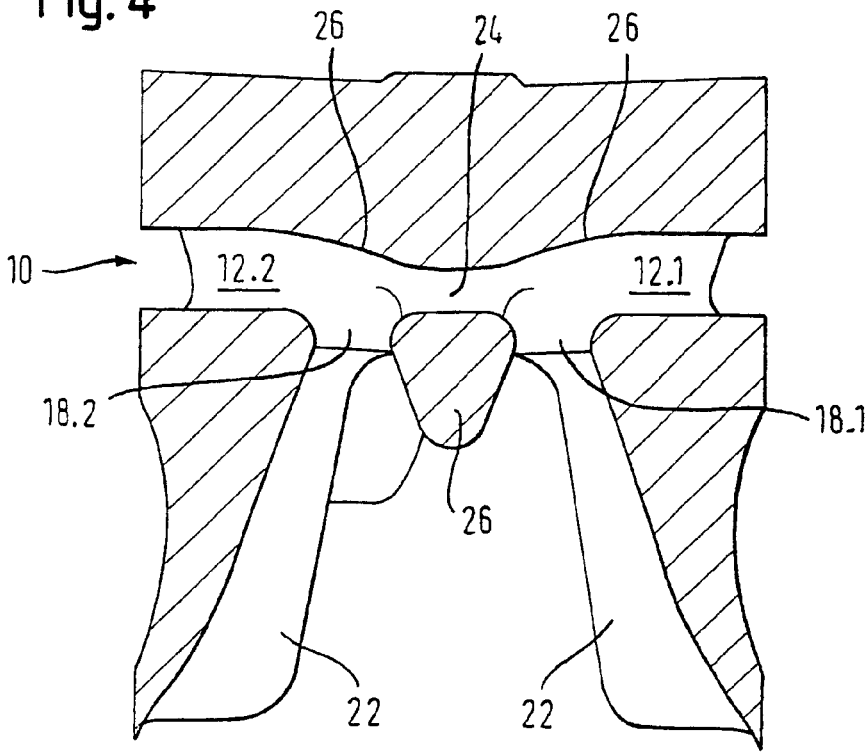
FIG. 4 a sectional view of the piston according to the invention in the region of the outlet ports.

By comparison, it emerges from the sectional diagram in FIG. 4, that this is a view perpendicular to a (supposed) piston pin axis. In FIG. 4 it can be seen that in this view both outlet ports 18.1 and 18.2 are symmetrical to each other whilst by comparison with FIG. 3 it emerges that the inlet port is provided asymmetrically. It can also be seen in FIG. 4 that although both outlet ports 18.1 and 18.2 are indeed connected by a small passage 24. Deflection of the relevant coolant flow nevertheless takes place by means of sloping walls 26 such that the coolant flow takes place at least to a large extent exclusively through only one outlet port 18.1 and 18.2 respectively assigned to each cooling duct section 12.1 and 12.2 respectively, and there is no occurrence of unfavourable mutual interference. Overall, due to the harmonious design of sloping and slightly concave walls 26, a fluidically favourable deflection of the relevant coolant flow takes place downwards, in the region between piston pin bosses 22, in order to ensure favourable lubrication of the piston pin in the installed condition. In addition, otherwise than illustrated in FIG. 4, walls 26 may be connected to "nose" 26 which is provided underneath passage 24. In this case, outlet ports 18.1 and 18.2 are completely separate from each other. As is already the case in the embodiment of FIG. 4, this means that as a result no coolant can get from one side to the other and neither is there is any impairment of coolant discharge at respective outlet port 18.1 and 18.2.

The invention claimed is:

1. Piston (20) for a combustion engine, which piston (20) comprises a circumferentially discontinuous cooling duct (10) with a single inlet port (14) and terminating at least two outlet ports (18) which are isolated from flow communication with one another across a space in respect of the coolant discharged across a space separating said at least two outlet ports (18).

2. Piston according to claim 1, characterised in that at least one flow dividing element (16) is provided in the region of the inlet port (14).

3. Piston according to claim 1, characterised in that an at least largely constant cross-section is provided in the region of at least one cooling duct section (12.1, 12.2) between the inlet port (14) and the relevant outlet port (18.1, 18.2).

4. Piston according to claim 1, characterised in that the inlet port (14) is provided asymmetrically in respect of the outlet ports (18).

5. Piston according to claim 1, characterised in that at least one of said outlet ports (18) is aimed towards a piston pin.

6. Piston according to claim 1, characterised in that at least one of said outlet ports (18) is disposed in a region between piston pin bosses (22).

7. Piston according to claim 1, characterised in that said piston is combined with a piston pin and a connecting rod, and at least one of said outlet ports (18) is provided in a region between a piston pin boss (22) and a connecting ring boss.

8. Combustion engine having at least one piston having a circumferentially discontinuous cooling duct (10) with a single inlet port (14) and terminating at least two outlet ports (18) which are isolated from flow communication with one another across a space in respect of the coolant discharged across a space separating said at least two outlet ports (18).

9. Combustion engine according to claim 8, characterised in that said engine comprises a means for generating a coolant jet which runs largely parallel to the piston axis.

10. Combustion engine according to claim 8, characterized in that at least one flow dividing element (16) is provided in the region of the inlet port (14).

11. Combustion engine according to claim 8, characterized in that an at least largely constant cross-section is provided in the region of at least one cooling duct section (12.1, 12.2) between the inlet port (14) and the relevant outlet port (18.1, 18.2).

12. Combustion engine according to claim 8, characterized in that the inlet port (14) is provided asymmetrically in respect of the outlet ports (18).

13. Combustion engine according to claim 8, characterized in that at least one of said outlet ports (18) is aimed towards a piston pin.

14. Combustion engine according to claim 8, characterized in that at least one of said outlet ports (18) is disposed in a region between piston pin bosses (22).

15. Combustion engine according to claim 8, characterized in that said piston is combined with a piston pin and a connecting rod, and at least one of said outlet ports (18) is provided in a region between a piston pin boss (22) and a connecting ring boss.

* * * * *